US005820423A

United States Patent [19]

Hsu

[11] Patent Number: 5,820,423

[45] Date of Patent: Oct. 13, 1998

[54] TERMINAL FOR MEMORY CARD CONNECTOR

[76] Inventor: Fu-Yu Hsu, No. 44-1, Potu Tayuan Hsiang, Tao-Yuan Hsien, Taiwan

[21] Appl. No.: 645,877

[22] Filed: May 14, 1996

[51] Int. Cl.[6] ..... H01R 11/22

[52] U.S. Cl. ..... 439/851

[58] Field of Search ..... 439/851–857, 439/325, 541.5, 629

[56] References Cited

U.S. PATENT DOCUMENTS

| | | | |
|---|---|---|---|
| 4,874,338 | 10/1989 | Bakermans | 439/851 |
| 5,326,288 | 7/1994 | Lu et al. | 439/851 |
| 5,620,347 | 4/1997 | Sawada | 439/851 |

*Primary Examiner*—Hien Vu
*Attorney, Agent, or Firm*—Morton J. Rosenberg; David I. Klein; Jun Y. Lee

[57] ABSTRACT

A terminal structure for memory card connectors includes a front positioning element; a rear positioning element oriented in the same direction as the front positioning element and connected to the front positioning element by means of two clamp pieces disposed therebetween; a retain element extending backwardly from the rear positioning element and having a U-shaped section; and a curved tail portion extending backwardly from the retain element. The upper and lower clamp pieces joining the front and rear positioning element have an upper contact portion and a lower contact portion respectively, the upper and lower contact portions curving inwardly towards each other and having respective inwardly curved, positioning slots such that an insert pin of a card mounting slot inserted into the terminal may have its upper and lower surfaces projecting from the positioning slots to expose on the contact portions respectively. The terminal has good resilience and firm clamping and positioning effects.

1 Claim, 6 Drawing Sheets

TERMINAL FOR MEMORY CARD CONNECTOR

BACKGROUND OF THE INVENTION (a) Field of the Invention:

The present invention relates generally to a terminal for memory card connectors, and more particularly to a terminal structure which has the advantages of firm hold, easy positioning and good contact.

(b) Description of the Prior Art:

Large capacity IC storage devices or memory cards with built-in CPU have become very popular today. The memory card is inserted into a card mounting slot which controls signal transmission or reception between the card and the computer to achieve read-out or write-in of data contained in the card.

With reference to FIG. 1, which shows a prior structure, comprising a card mounting slot 1 has a front end provided with a guide groove 11 and is internally provided with a plurality of insert pins 12 for connection with the circuit board; a memory card 3 and a connector 4 disposed at a front end thereof are inserted into the guide groove 11 to be connected to the card mounting slot 1. With reference to FIG. 2, corresponding to each insert pin 12 of the card mounting slot 1, the connector 4 has a terminal 41 disposed inside for achieving continuous connection. Exemplars of related prior art structures are seen in U.S. Pat. Nos. 4,564,258; 4,666,227; 4,687.278; 4,707,052; 4,702,277; 4,721,481; 4,722,704; 4,767,350; 4,840,588; 4,874,338; 4,886,747; 4,909,746; 5,256,588; 4,776,651; and 5,183,421.

A common type of terminal structure known to the applicant is shown in FIG. 2 as well as FIG. 3. The terminal 41 consists of an upper clamp piece 411 and a lower clamp piece 412 which together hold the insert pin 12 therebetween. However, such a structure may only provide two point contacts. Thus, the insert pin 12 is prone to displace sideways, resulting in poor electrical connection. The stability of the computer system is therefore not satisfactory.

Another type of terminal structure known to the applicant is shown in FIGS. 4 and 5. A terminal 42 is punched from a metal sheet. It consists of two C-shaped clamp bodies 420 at its ends, the clamp bodies being linked by three separate clamp strips 421, 422 and 423 for clamping the insert pin 12. Such type of terminal structure, however, has poor resilience, so that it is necessary to push the memory card 3 with a relatively great force when inserting it into the card mounting slot 11 in order that the terminals 42 may fit onto the insert pins 12. With further reference to FIG. 5, although the configuration of three clamp strips 421, 422 and 423 may prevent the insert pin 12 clamped thereby from deviating sideways, there is a major disadvantage. The connection mechanism of memory cards is restricted by its particular features so that the contact portion must be configured to be very small and has to be able to stand over 5000 times of connector-in and connector-out operations. Under these conditions, the contact portion of the memory card is designed to consist an array of contacts or terminals. The terminal 42 is therefore considered to have a configuration with minimal contact surfaces with the insert pin so as to reduce the force required to connector out the memory card and ensure its capacity to withstand frequent plugging operations. In the prior art shown in FIGS. 4 and 5, the three clamp strips 421, 422 and 423 connecting the C-shaped clamp bodies 420 at either end have low resilience and the terminal 42 is difficult to fit onto the insert pin 12. After a period of use, the three clamp strips 421, 422 and 423 may suffer from metal fatigue, so that the insert pin 12 can no longer simultaneously contact all of the three clamp strips 421, 422 and 423, resulting in poor electrical contact, which may affect the stability of the computer system.

SUMMARY OF THE INVENTION

Accordingly, a primary object of the present invention is to provide a terminal structure for memory card connectors, which has more contact points and large contact surfaces with an insert pin than the prior art to achieve more stable electrical connection.

Another object of the present invention is to provide a terminal structure for memory card connectors, which has firm hold and better resilience for positioning an insert pin retained therein, and preventing the insert pin from undue displacement and breaking.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
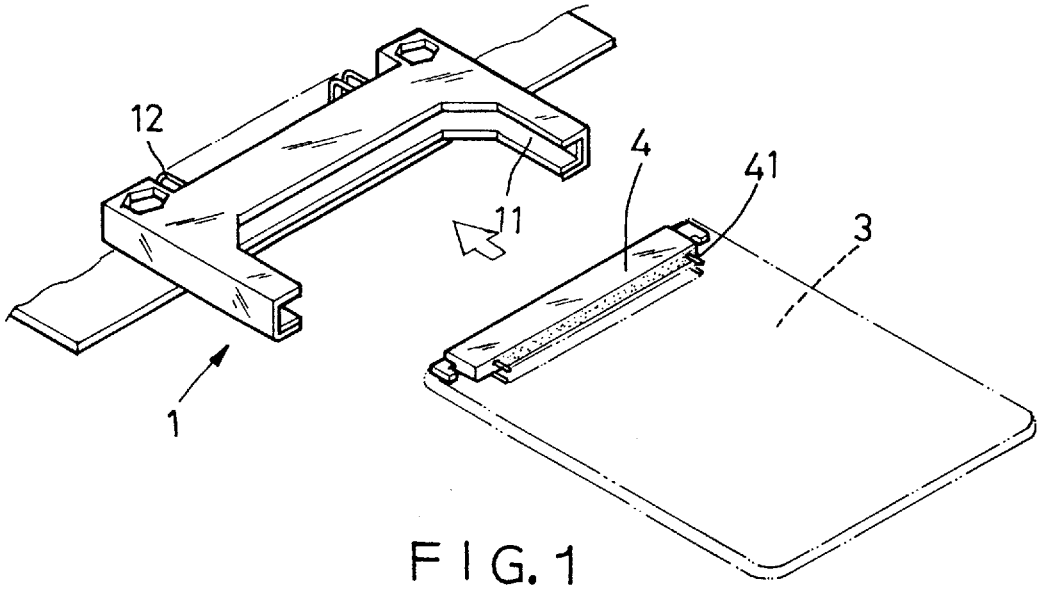
FIG. 1 (PRIOR ART)
FIG. 1 is an elevational view of a prior memory card mounting mechanism.
Figure 2:
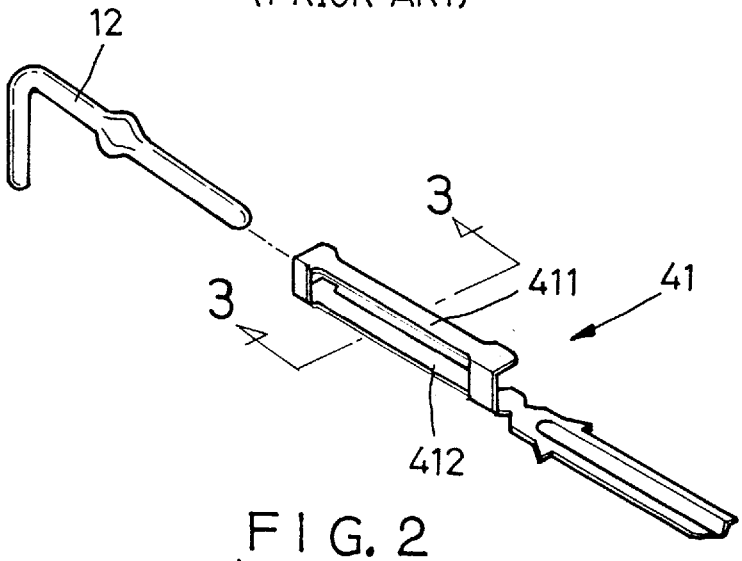
FIG. 2 (PRIOR ART)
FIG. 2 is an elevational view of a prior terminal structure and an insert pin.
Figure 3:
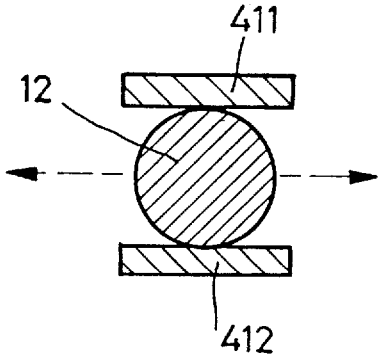
FIG. 3 (PRIOR ART)
FIG. 3 is a sectional view taken along line 3—3 of FIG. 2.
Figure 4:
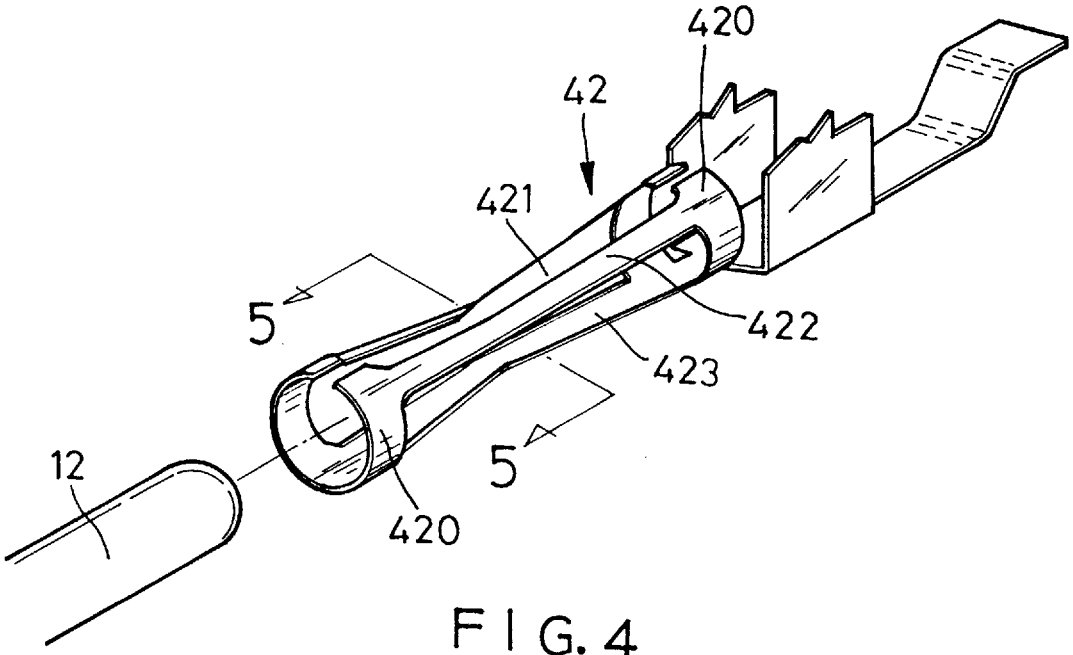
FIG. 4 (PRIOR ART)
FIG. 4 is an elevational view of another prior terminal structure.
Figure 5:
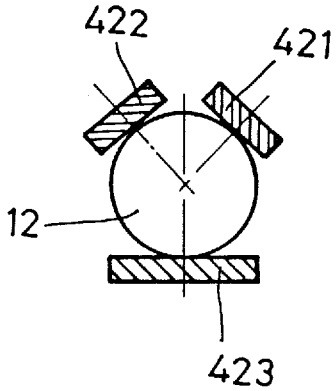
FIG. 5 (PRIOR ART)
FIG. 5 is a sectional view taken along line 5—5 of FIG. 4.
Figure 6:
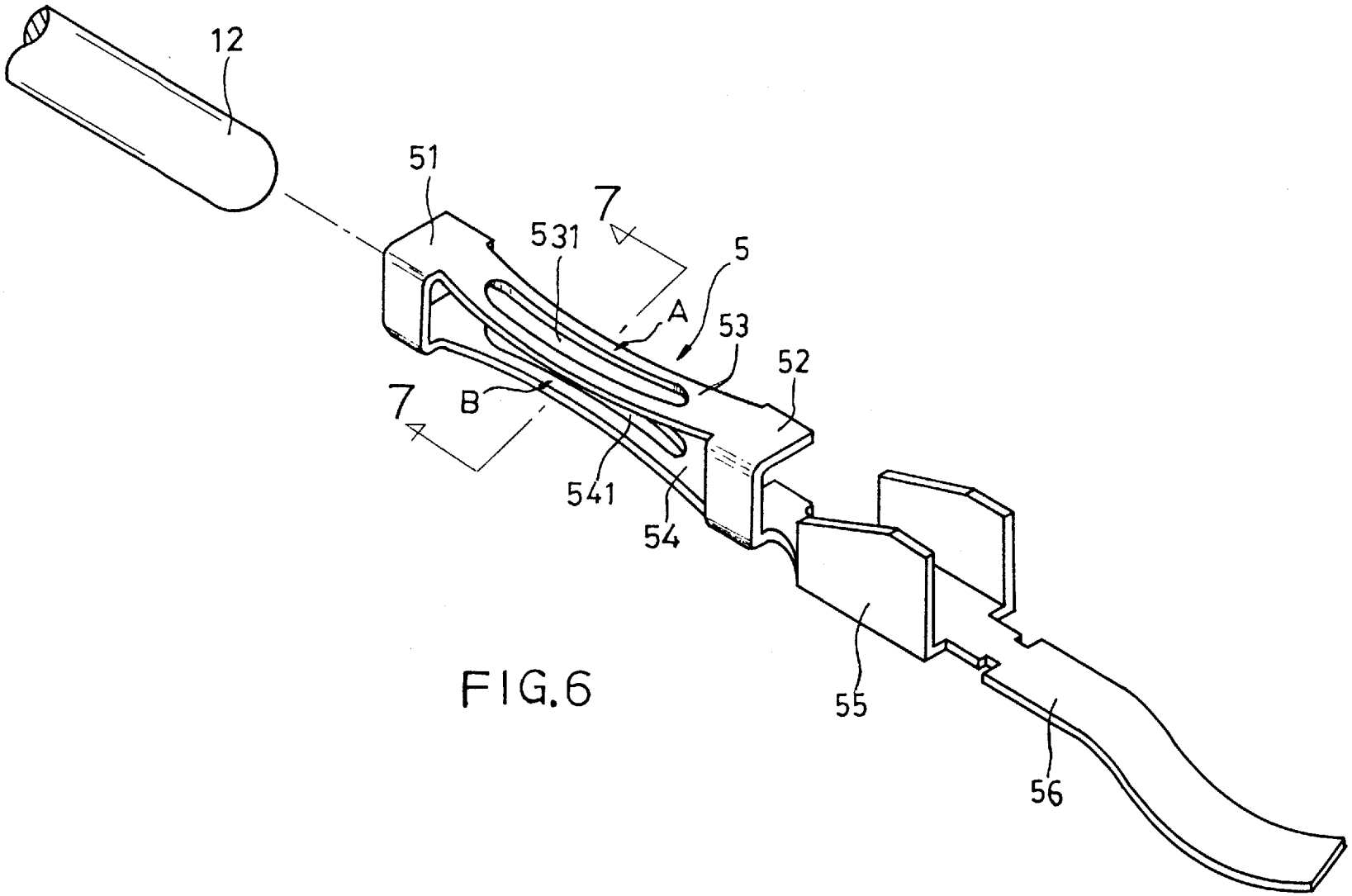
FIG. 6 is an elevational view of a terminal according to the present invention.
Figure 7:
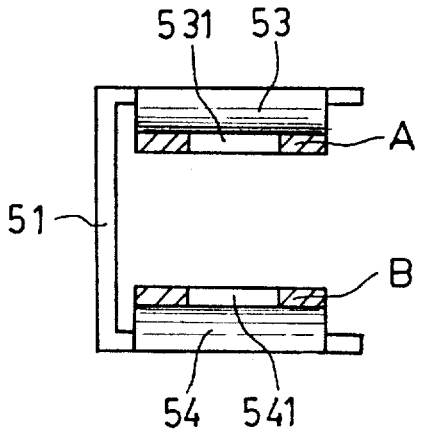
FIG. 7 is a sectional view taken along line 7—7 of FIG. 6.
Figure 8:
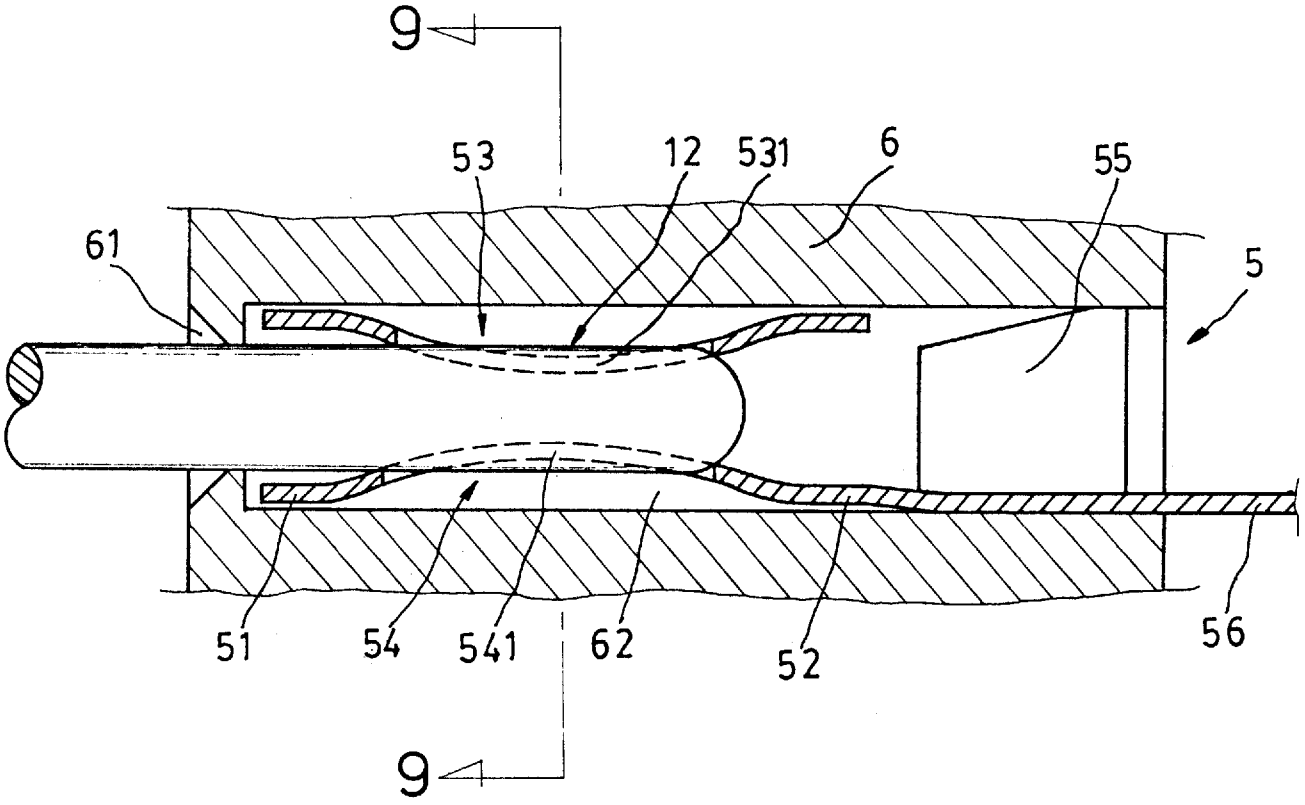
FIG. 8 is a sectional view illustrating the terminal fitted onto an insert pin.

With reference to FIG. 6, a terminal 5 for memory card connectors of the present invention essentially comprises a front positioning element 51 which is shaped by bending; a rear positioning element 52 which is oriented in the same direction as the front positioning element 51 and is connected to the front positioning element 51 by means of two clamp pieces 53 and 54 disposed therebetween; a retain element 55 extending backwardly from the rear positioning element 52 and has a U-shaped section; and a tail portion 56 extending backwardly from the retain element 55 and is slightly curved, wherein the upper and lower clamp pieces 53 and 54 joining the front and rear positioning elements 51 and 52 have inwardly curved resilient contact portions A and B respectively. Both contact portions A and B have positioning slots 531, 532 respectively. The positioning slots 531 and 532 also curved inwardly with respect to each other such that an insert pin 12 held therebetween may have its upper and lower surfaces exposing on the contact portions A and B respectively, as shown in FIG. 8. By means of this arrangement, the terminal 5 according to the present invention has good resilience and is capable of firmly holding the insert pin 12 therein.

Figure 9:
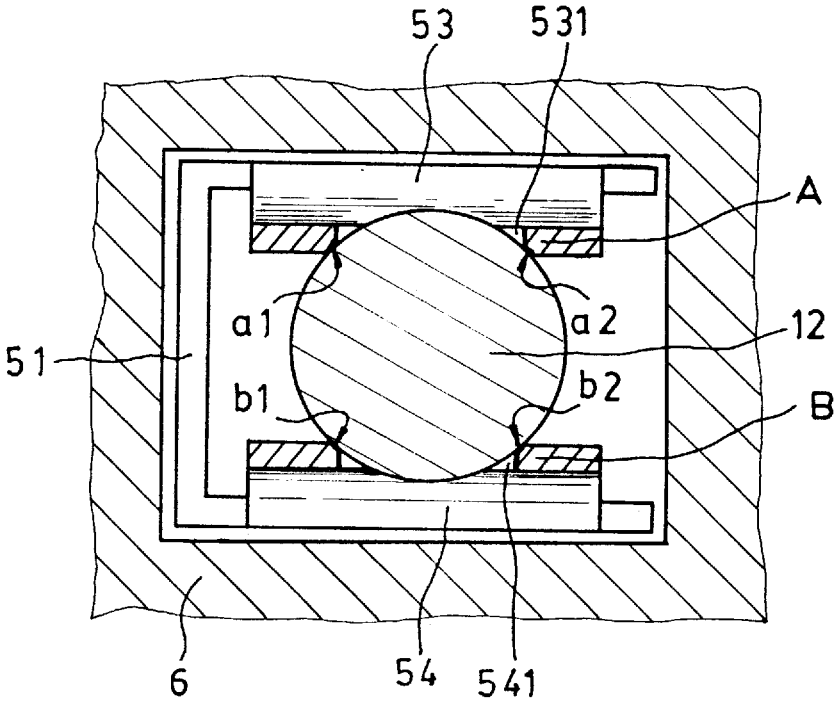
FIG. 9 is a sectional view taken along line 9—9 of FIG. 8.

With reference to FIGS. 8 and 9, which illustrate the terminal and a connector 6 of a memory card. The connector 6 has an array of flared insert holes 61 for connection with the insert pins 12. Each insert hole 61 has a square slot 62 at a rear end thereof. The square slot 62 has a larger diameter than the insert hole 61 for insertion of the front and rear positioning elements 51 and 52 thereunto. The retain element 55 is provided to position the terminal 5 within the square hole 62. The insert pin 12 is inserted via the insert hole 61 into the terminal 5 between the upper and lower clamp pieces 53 and 54, guided by their curves. At this point, the distance between the positioning slots 531 and 532 is smaller than the outer diameter of the insert pin 12 so that the upper and lower surfaces of the insert pin 12 projects from the positioning slots 531 and 532 to be exposed on the contact portions A and B respectively. Thus, the upper and lower sides of the positioning slots 531 and 532 uniformly contact the periphery of the insert pin 12. By means of this arrangement, the insert pin 12 may contact the terminal 5 at four points, a1, a2, b1 and b2, so that it may be held firmly therein and cannot deviate therefrom, as shown in FIG. 9.

Figure 10:
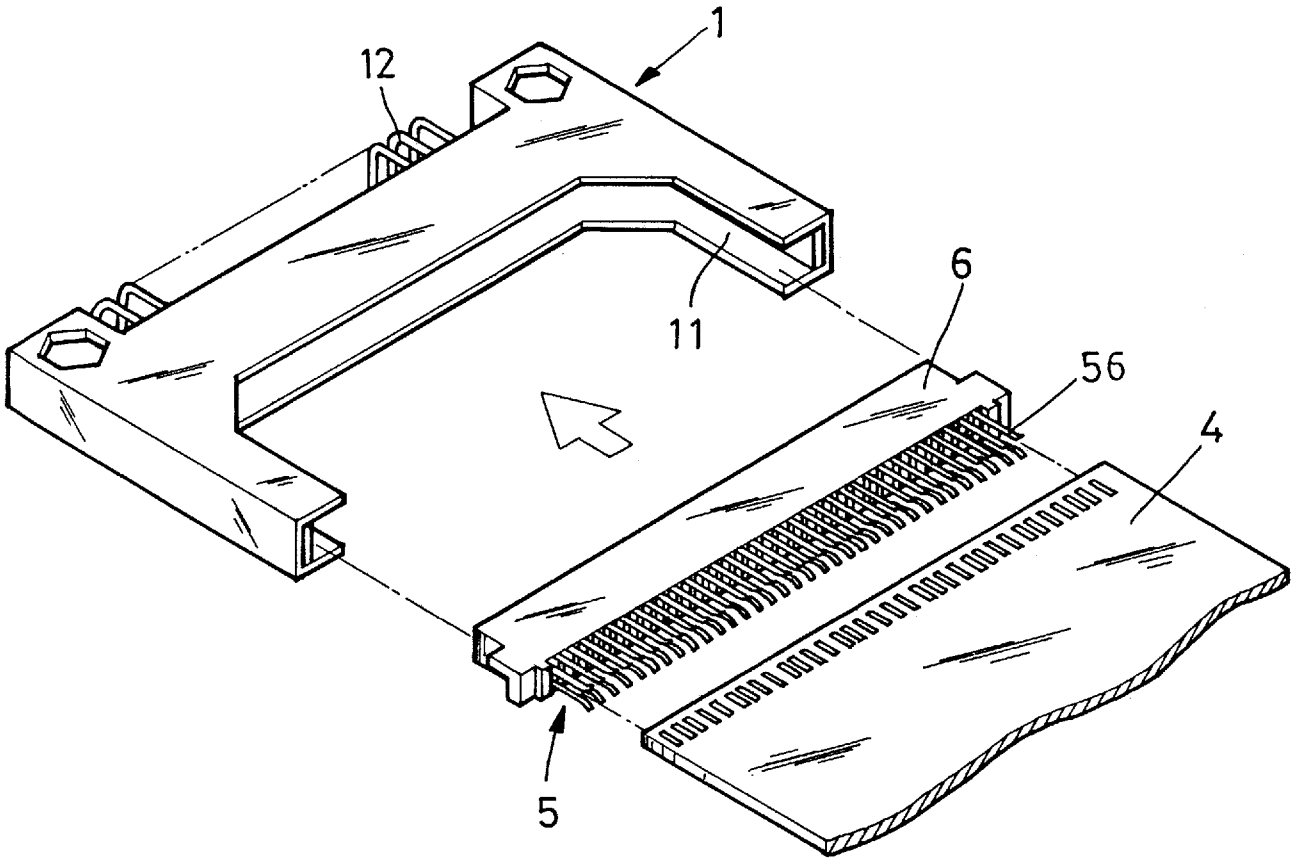
FIG. 10 is an elevational view illustrating the mounting mechanism according to the present invention.

Referring to FIG. 10, an array of terminals 5 are disposed on the connector 6, with the tail portions 56 projecting from connector 6 for connection with a memory card 4. The memory card 4 is inserted in to a guide slot 11 of a card mounting slot 1 by means of the connector 6, with the terminals 5 engaging the insert pins 12 of the card mounting slot 1.

From the above description, it can be seen that since the insert pin 12 contacts the terminal 5 at four points, a1, a2, b1 and b2, it can be held therein firmly and cannot deviate therefrom. Besides, the terminal 5 has relatively good resilience and may, therefore, exert a suitable pressure on the insert pin 12 inserted therein. Hence, the connector 6 provided with the terminals 5 of the present invention may be inserted with relative ease into the card mounting slot 1 and may withstand over 5000 times of plugging operation, eliminating the drawbacks with the prior art. Although the present invention has been illustrated and described with reference to the preferred embodiment thereof, it should be understood that it is in no way limited to the details of such embodiment but is capable of numerous modifications within the scope of the appended claims.

What is claimed is:

1. A terminal structure for card connectors designed to receive an insert pin comprising:

a U-shaped first positioning element;

a U-shaped second positioning element, coupled to said U-shaped first positioning member in aligned and positionally displaced relationship therewith;

at least one pair of arcuately formed clamp members defining an upper clamp member and a lower clamp member, said upper and lower clamp members located between said first positioning element and second positioning element, and formed in one piece construction therewith;

said upper and lower clamp members defining a pair of contact portions having a positioning slot formed therethrough, said positioning slots being arcuately formed inwardly directed each to the other;

a retaining member extending outward from a rear section of said second positioning element and having a substantially U-shaped cross-section; and, a curved tail member extending from the rear of the said retaining member and coupled thereto, wherein said upper clamp member and said lower clamp member include an upper contact portion and a lower contact portion, respectively, said upper and lower contact portions being resilient and arcuately formed inwardly towards each other whereby a pin inserted into the terminal structure will have its opposing sides engaged with, and held firmly by, said resilient upper and lower contact portions, and opposing sides of said pin project through said positioning slots to be exposed to said contact portions.

* * * * *